US011594167B2

(12) United States Patent
Kang et al.

(10) Patent No.: US 11,594,167 B2
(45) Date of Patent: Feb. 28, 2023

(54) DISPLAY DEVICE AND DRIVING METHOD THEREOF

(71) Applicant: SAMSUNG DISPLAY CO., LTD., Yongin-si (KR)

(72) Inventors: Byeong Doo Kang, Yongin-si (KR); Jong Man Kim, Yongin-si (KR); Jae Woo Ryu, Yongin-si (KR); Yoon Sup Kim, Yongin-si (KR); Yoon Ju Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/511,859

(22) Filed: Oct. 27, 2021

(65) Prior Publication Data

US 2022/0277683 A1 Sep. 1, 2022

(30) Foreign Application Priority Data

Feb. 26, 2021 (KR) ..... 10-2021-0026887

(51) Int. Cl.
*G09G 3/20* (2006.01)

(52) U.S. Cl.
CPC ... *G09G 3/2007* (2013.01); *G09G 2300/0842* (2013.01); *G09G 2310/08* (2013.01); *G09G 2320/0271* (2013.01); *G09G 2330/02* (2013.01)

(58) Field of Classification Search
CPC ..... G09G 3/2007; G09G 2300/0842; G09G 2310/08; G09G 2320/0271; G09G 2330/02
See application file for complete search history.

(56) References Cited

U.S. PATENT DOCUMENTS

| | | | | |
|---|---|---|---|---|
| 9,269,301 | B2 | 2/2016 | Lee et al. | |
| 2014/0198091 | A1* | 7/2014 | Shin | G09G 3/3291 345/82 |
| 2014/0354298 | A1* | 12/2014 | Obata | H02K 15/105 324/546 |
| 2014/0354698 | A1* | 12/2014 | Lee | G09G 3/3258 345/690 |
| 2014/0354703 | A1* | 12/2014 | Han | G09G 3/3233 345/83 |
| 2019/0051240 | A1* | 2/2019 | Nakatani | G09G 3/3208 |
| 2021/0319740 | A1* | 10/2021 | Pyun | G09G 3/20 |

FOREIGN PATENT DOCUMENTS

| | | | |
|---|---|---|---|
| KR | 101481672 | B1 | 1/2015 |
| KR | 101588449 | B1 | 1/2016 |
| KR | 102061554 | B1 | 1/2020 |

* cited by examiner

*Primary Examiner* — Kenneth Bukowski
(74) *Attorney, Agent, or Firm* — Cantor Colburn LLP

(57) ABSTRACT

A driving method of a display device including a power source which supplies a power voltage to a power base line, and pixels connected to power branch lines commonly connected to the power base line, includes calculating a first scale factor based on input grayscales received during a first frame period; calculating first output grayscales by applying the first scale factor to first input grayscales received during a second frame period, where the second frame period is a frame period immediately next to the first frame period; displaying an image by at least a part of the pixels based on the first output grayscales; and providing a first current limiting signal to the power source and calculating a second scale factor smaller than the first scale factor when a current of the power base line exceeds a reference value.

20 Claims, 9 Drawing Sheets

DISPLAY DEVICE AND DRIVING METHOD THEREOF

The application claims priority to Korean Patent Application No. 10-2021-0026887, filed Feb. 26, 2021, and all the benefits accruing therefrom under 35 U.S.C. § 119, the content of which in its entirety is herein incorporated by reference.

BACKGROUND

Field

The present invention relates to a display device and a driving method thereof.

Discussion

With the development of information technology, the importance of a display device, which is a connection medium between users and information, has been emphasized. In response to this, the use of the display device such as a liquid crystal display device, an organic light emitting display device, and the like has been increasing.

An image frame to be displayed by the display device may be composed of grayscales. However, when the image frame includes only high grayscales, an overcurrent that exceeds an allowable range may flow through the display device. Accordingly, when the overcurrent is expected, the grayscales may be scaled down so that a current within the allowable range flows through the display device.

SUMMARY

However, when the display device does not have a frame memory, since a current image frame cannot be delayed and output, a scale factor based on grayscales of the current image frame cannot be applied to the current image frame. Accordingly, a scale factor based on grayscales of a previous image frame may be applied to the current image frame.

In this case, in a worst pattern in which a black image and a white image are switched in units of frames, it is not possible to prevent the overcurrent from flowing through the display device.

A technical problem to be solved is to provide a display device capable of preventing occurrence of overcurrent in a worst pattern even when a frame memory is not provided and a driving method thereof.

A display device according to an embodiment of the present invention includes: a scale factor providing unit which calculates a first scale factor based on input grayscales received during a first frame period; a grayscale converter which calculates first output grayscales by applying the first scale factor to first input grayscales received during a second frame period, where the second frame period is a frame period immediately next to the first frame period; pixels connected to power branch lines commonly connected to a power base line, where at least a part of the pixels is configured to display an image based on the first output grayscales; a power source which supplies a power voltage to the power base line; and a current limiting unit which provides a first current limiting signal to the power source and provides a second current limiting signal to the scale factor providing unit when a current of the power base line exceeds a reference value.

The power source may reduce a magnitude of the power voltage when receiving the first current limiting signal.

The scale factor providing unit may provide a second scale factor smaller than the first scale factor when receiving the second current limiting signal.

The grayscale converter may calculate second output grayscales by applying the second scale factor to second input grayscales received during the second frame period, and another part of the pixels may be configured to display an image based on the second output grayscales.

The pixels may start to display the image based on the first output grayscales and the second output grayscales during the second frame period and end displaying the image during a third frame period after the second frame period.

The scale factor providing unit may calculate the first scale factor after receiving all of the input grayscales of the first frame period and before starting to receive the first input grayscales of the second frame period.

The scale factor providing unit may calculate the first scale factor smaller as a load value of the input grayscales of the first frame period increases.

The load value may be a sum of gamma conversion values of the input grayscales.

The power source may include feedback resistors, and the current limiting unit may provide the first current limiting signal to a node between the feedback resistors.

The current limiting unit may include a comparator having input terminals connected to the power base line; an integrator having an input terminal connected to an output terminal of the comparator; and a buffer having an input terminal connected to the integrator and an output terminal connected to the node between the feedback resistors.

The current limiting unit may further include a trigger connected between the output terminal of the comparator and the input terminal of the integrator.

The current limiting unit may further include a switch connected between an output terminal of the integrator and the input terminal of the buffer; and a reset switch having a first electrode connected to the output terminal of the integrator.

According to an embodiment of the present invention, a driving method of a display device including a power source which supplies a power voltage to a power base line, and pixels connected to power branch lines commonly connected to the power base line, includes calculating a first scale factor based on input grayscales received during a first frame period; calculating first output grayscales by applying the first scale factor to first input grayscales received during a second frame period, where the second frame period is a frame period immediately next to the first frame period; displaying an image by at least a part of the pixels based on the first output grayscales; and providing a first current limiting signal to the power source and calculating a second scale factor smaller than the first scale factor when a current of the power base line exceeds a reference value.

The driving method may further include reducing a magnitude of the power voltage by the power source when receiving the first current limiting signal.

The driving method may further include calculating second output grayscales by applying the second scale factor to second input grayscales received during the second frame period; and displaying an image by another part of the pixels based on the second output grayscales.

The pixels may start to display the image based on the first output grayscales and the second output grayscales during the second frame period and end displaying the image during a third frame period after the second frame period.

In the calculating the first scale factor, the first scale factor may be calculated after receiving all of the input grayscales of the first frame period and before starting to receive input grayscales of a next frame period of the first frame period.

In the calculating the first scale factor, the first scale factor may be calculated smaller as a load value of the input grayscales in the first frame period increases.

The load value may be a sum of gamma conversion values of the input grayscales.

The power source may include feedback resistors, and the power source may receive the first current limiting signal through a node between the feedback resistors.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
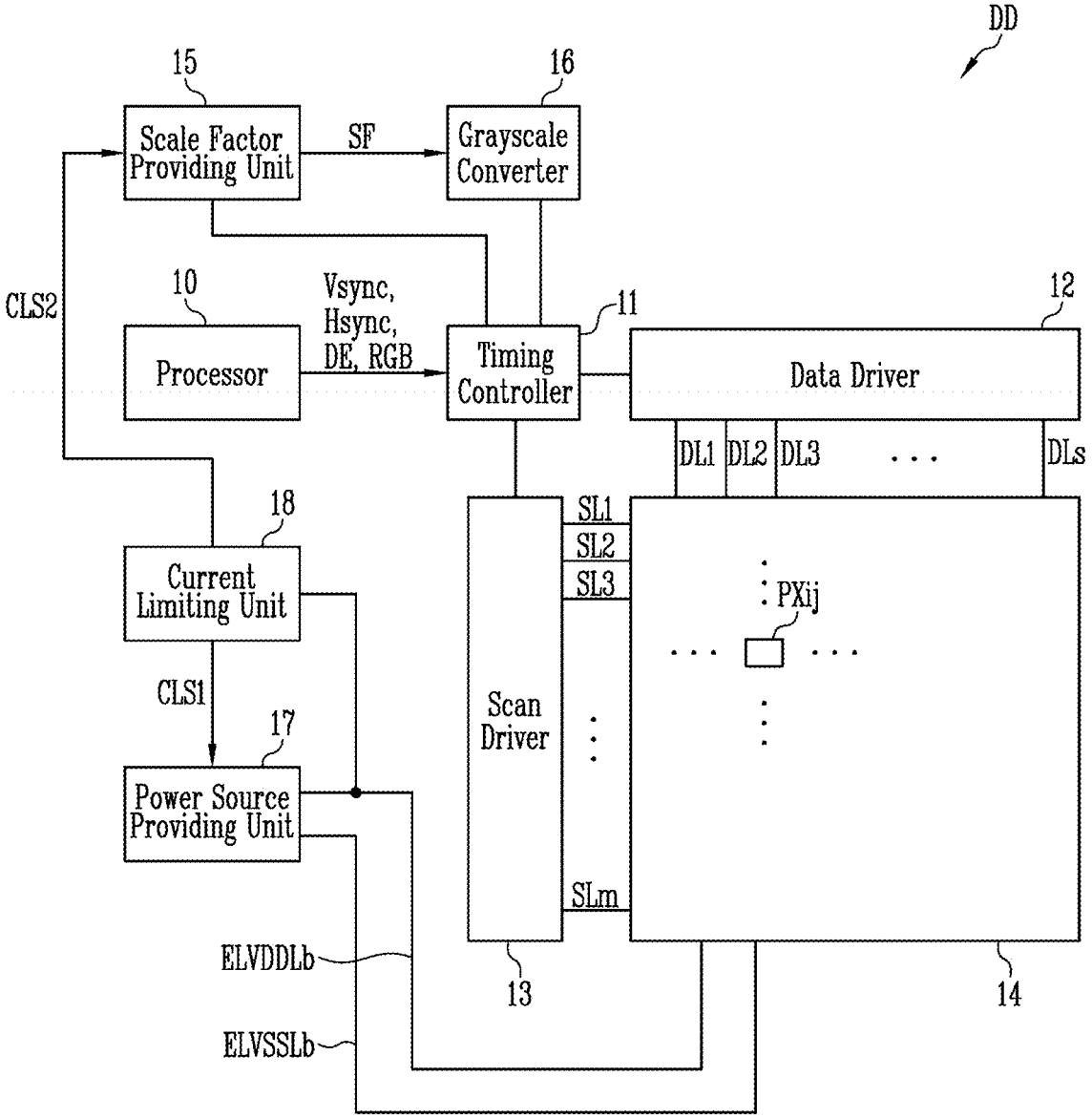
FIG. 1 is a diagram for explaining a display device according to an embodiment of the present invention.

Hereinafter, various embodiments of the present invention will be described in detail with reference to the accompanying drawings so that those of ordinary skill in the art may easily implement the present invention. The present invention may be embodied in various different forms and is not limited to the embodiments described herein.

In order to clearly describe the present invention, parts that are not related to the description are omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the present invention is not necessarily limited to those shown in the drawings. In the drawings, thicknesses may be exaggerated to clearly express the layers and regions.

It will be understood that when an element is referred to as being "connected to" another element, it can be directly connected to the other element or intervening elements may be present therebetween. In contrast, when an element is referred to as being "directly connected to" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In addition, in the description, the expression "is the same" may mean "substantially the same". That is, it may be the same enough to convince those of ordinary skill in the art to be the same. In other expressions, "substantially" may be omitted.

FIG. 1 is a diagram for explaining a display device according to an embodiment of the present invention.

Referring to FIG. 1, a display device DD according to an embodiment of the present invention may include a processor 10, a timing controller 11, a data driver 12, a scan driver 13, a pixel unit 14, a scale factor providing unit 15, and a grayscale converter 16.

The processor 10 may provide a vertical synchronization signal Vsync, a horizontal synchronization signal Hsync, a data enable signal DE, and input grayscales RGB. The processor 10 may correspond to a graphics processing unit ("GPU"), a central processing unit ("CPU"), an application processor ("AP"), or the like. The processor 10 may refer to one integrated chip ("IC") or may refer to a group consisting of a plurality of ICs.

The processor 10 may supply the input grayscales RGB in active periods of frame periods. In this case, the processor 10 may notify whether the input grayscales RGB are supplied using the data enable signal DE. For example, the data enable signal DE may be at an enable level while the input grayscales RGB are supplied, and may be at a disable level during the remaining periods. For example, the data enable signal DE may include pulses of the enable level in units of horizontal periods in each active period. The input grayscales RGB may be supplied in units of horizontal lines in response to a pulse of the enable level of the data enable signal DE. A horizontal line may mean pixels (for example, a pixel row) connected to the same scan line. For example, the horizontal line may mean pixels in which each scan transistor is connected to the same scan line. The scan transistor may mean a transistor in which a source or drain electrode is connected to a data line and a gate electrode is connected to a scan line.

Each cycle of the vertical synchronization signal Vsync may correspond to each frame period. For example, the vertical synchronization signal Vsync may indicate an active period of a corresponding frame period at a logic high level, and may indicate a blank period of the corresponding frame period at a logic low level. Each cycle of the horizontal synchronization signal Hsync may correspond to each horizontal period.

The timing controller 11 may receive the vertical synchronization signal Vsync, the horizontal synchronization signal Hsync, the data enable signal DE, and the input grayscales RGB from the processor 10.

The timing controller 11 may supply control signals corresponding to specifications of the data driver 12, the scan driver 13, the scale factor providing unit 15, and the grayscale converter 16. In addition, the timing controller 11 may provide the input grayscales RGB to the scale factor providing unit 15 and the grayscale converter 16. The timing controller 11 may provide output grayscales received from the grayscale converter 16 to the data driver 12. The timing controller 11, the scale factor providing unit 15, the grayscale converter 16, and the data driver 12 may be configured as separate ICs that are independent of each other, or may be configured as an IC in which two or more functional units are integrated.

The scale factor providing unit 15 may calculate a scale factor SF based on the input grayscales RGB received during each frame period. For example, the scale factor providing unit 15 may calculate a first scale factor SF1 (See FIG. 5) based on the input grayscales RGB received during a first frame period.

The scale factor SF may be a value of 0 or more and 1 or less. The scale factor SF may be a value of 0% or more and 100% or less. In addition, a range of the scale factor SF and an expression method thereof may be variously defined according to the display device DD.

The scale factor providing unit 15 may prevent an overcurrent from flowing through the display device DD by adjusting (e.g., reducing) the scale factor SF so that a global current does not exceed a current limit value. A current flowing through a light emitting diode of each pixel PXij may be defined as a branch current, and the global current may be defined as the sum of the branch currents of all pixels. For example, a current flowing through a first power base line ELVDDLb or a second power base line ELVSSLb which is a current before branched to the pixels may be the global current.

The grayscale converter 16 may convert the input grayscales RGB into the output grayscales by applying the scale factor SF to the input grayscales RGB. For example, the grayscale converter 16 may calculate first output grayscales by applying the first scale factor SF1 to first input grayscales RGBF2 received during a second frame period FP2 after the first frame period FP1.

In an embodiment, for example, the grayscale converter 16 may calculate the output grayscales by multiplying the input grayscales RGB by a corresponding scale factor SF. For example, the grayscale converter 16 may generate the output grayscales by reducing the input grayscales RGB at a ratio according to the scale factor SF. For example, the output grayscales may be less than or equal to the input grayscales RGB.

The data driver 12 may generate data voltages to be provided to data lines DL1, DL2, DL3, and DLs using the output grayscales and the control signals, where s may be an integer greater than 0. For example, the data driver 12 may sample the output grayscales using a clock signal, and apply the data voltages corresponding to the output grayscales to the data lines DL1 to DLs in units of pixel rows.

The scan driver 13 may receive a clock signal, a scan start signal, and the like from the timing controller 11 to generate scan signals to be provided to scan lines SL1, SL2, SL3, and SLm, where m may be an integer greater than 0.

The scan driver 13 may sequentially supply the scan signals having a turn-on level pulse to the scan lines SL1 to SLm. The scan driver 13 may include scan stages configured in the form of a shift register. The scan driver 13 may generate the scan signals by sequentially transferring the scan start signal in the form of a turn-on level pulse to the next scan stage under control of the clock signal.

The pixel unit 14 may include the pixels. Each pixel PXij may be connected to a corresponding data line and a corresponding scan line, where i and j may be integers greater than 0. The pixel PXij may mean a pixel in which the scan transistor is connected to an i-th scan line and a j-th data line.

The pixels are connected to first power branch lines commonly connected to the first power base line ELVDDLb, and at least a part of the pixels may display an image based on the first output grayscales. The first power branch lines to which respective pixels are connected may be different from each other. Also, the pixels may be connected to second power branch lines commonly connected to the second power base line ELVSSLb. The second power branch lines to which respective pixels are connected may be different from each other.

The power source providing unit 17 may include a first power source and a second power source. The first power source may supply a first power voltage to the first power base line ELVDDLb. For example, the first power source (See FIG. 7) may be a boost converter. The second power source may supply a second power source voltage to the second power base line ELVSSLb. For example, the second power source may be a buck-boost converter. The first power source and the second power source may include or be composed of other converters using conventional technology. During a period in which the image is displayed, the first power voltage may be greater than the second power source voltage.

When a current of the first power base line ELVDDLb exceeds a reference value, a current limiting unit 18 may provide a first current limiting signal CLS1 to the first power source and may provide a second current limiting signal CLS2 to the scale factor providing unit 15. When receiving the first current limiting signal CLS1, the first power source may reduce the magnitude of the first power voltage. In addition, when receiving the second current limiting signal CLS2, the scale factor providing unit 15 may provide a second scale factor (e.g., SF1*m* in FIG. 9) smaller than the first scale factor. Accordingly, the grayscale converter 16 may calculate second output grayscales by applying the second scale factor to second input grayscales received during the second frame period. Accordingly, another part of the pixels may display an image based on the second output grayscales.

In an embodiment, for example, during the second frame period, a part of the pixels of the pixel unit 14 may display the image to which the first scale factor is applied, and another part of the pixels of the pixel unit 14 may display the image to which the second scale factor is applied. For example, the pixels connected to a first scan line SL1 to an n-th scan line SLn may display the image to which the first scale factor is applied. In this case, the current limiting unit 18 may detect that the current of the first power base line ELVDDLb exceeds the reference value, provide the first current limiting signal CLS1 to limit primary current using the first power source, and provide the second current limiting signal CLS2 to limit secondary current using the scale factor providing unit 15. The scale factor providing unit 15 may provide the second scale factor to the pixels connected to an (n+1)th scan line to a m-th scan line SLm after receiving the second current limiting signal CLS2. Here, n may be an integer smaller than m.

According to the embodiment of the present invention, since the scale factor SF can be changed in real time even during the frame period, occurrence of overcurrent in a worst pattern can be effectively prevented even when the display device DD does not have a frame memory.

In addition, in the above-described embodiments, two scale factors SF are applied during the second frame period, but in other embodiments, three or more scale factors SF may be applied during the second frame period.

The global current flowing from the first power base line ELVDDLb to the second power base line ELVSSLb may be maintained substantially the same. Accordingly, in another embodiment, the current limiting unit 18 may be configured to detect whether a current of the second power base line ELVSSLb exceeds the reference value.

In another embodiment, the current limiting unit 18 may be configured to provide the first current limiting signal CLS1 to the second power source. For example, when receiving the first current limiting signal CLS1, the second power source may be configured to increase the magnitude of the second power source voltage.

Although not shown, the display device DD may further include an emission driver. The emission driver may receive a clock signal, an emission stop signal, and the like from the timing controller 11 to generate emission signals to be provided to emission lines. For example, the emission driver may include emission stages connected to the emission lines. The emission stages may be configured in the form of a shift register. For example, a first emission stage may generate an emission signal of a turn-off level based on the emission stop signal of the turn-off level, and the remaining emission stages may sequentially generate emission signals of the turn-off level based on the emission signal of the turn-off level of a previous emission stage.

When the display device DD includes the emission driver, each pixel PXij may further include a transistor connected to an emission line. The transistor may be turned off during a data writing period of each pixel PXij to prevent the pixel PXij from emitting light. Hereinafter, it is assumed that the emission driver is not provided.

Figure 2:
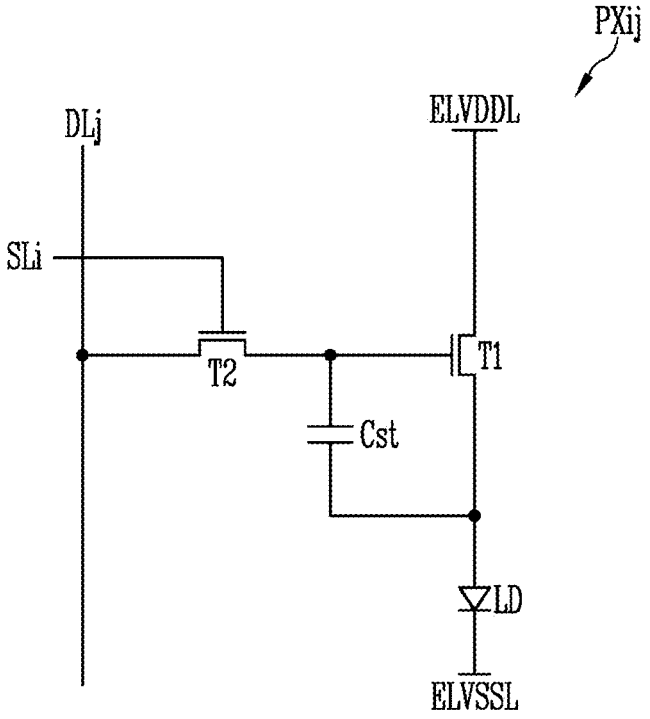
FIG. 2 is a diagram for explaining a pixel according to an embodiment of the present invention.

FIG. 2 is a diagram for explaining a pixel according to an embodiment of the present invention.

Referring to FIG. 2, a pixel PXij may include transistors T1 and T2, a storage capacitor Cst, and a light emitting diode LD.

Hereinafter, a circuit composed of N-type transistors will be described as an example. However, those skilled in the art may design a circuit composed of P-type transistors by changing the polarity of a voltage applied to a gate terminal. Similarly, those skilled in the art will be able to design a circuit composed of a combination of a P-type transistor and an N-type transistor. The P-type transistor may generally refer to a transistor in which the amount of current to be conducted increases when a voltage difference between a gate electrode and a source electrode increases in a negative direction. The N-type transistor may generally refer to a transistor in which the amount of current to be conducted increases when the voltage difference between the gate electrode and the source electrode increases in a positive direction. The transistors may be composed of various forms such as a thin film transistor ("TFT"), a field effect transistor ("FET"), and a bipolar junction transistor ("BJT").

A first transistor T1 may have a gate electrode connected to a first electrode of the storage capacitor Cst, a first electrode connected to a first power branch line ELVDDL, and a second electrode connected to a second electrode of the storage capacitor Cst. The first transistor T1 may be referred to as a driving transistor.

A second transistor T2 may have a gate electrode connected to an i-th scan line SLi, a first electrode connected to a j-th data line DLj, and a second electrode connected to the gate electrode of the first transistor T1. The second transistor T2 may be referred to as a scan transistor.

The first electrode of the storage capacitor Cst may be connected to the gate electrode of the first transistor T1, and the second electrode may be connected to the second electrode of the first transistor T1.

The light emitting diode LD may have an anode connected to the second electrode of the first transistor T1 and a cathode connected to a second power branch line ELVSSL. The light emitting diode LD may be composed of an organic light emitting diode, an inorganic light emitting diode, a quantum dot/well light emitting diode, or the like. Meanwhile, FIG. 2 shows the pixel PXij including one light emitting diode LD as an example, but in another embodiment, the pixel PXij may include a plurality of light emitting diodes connected in series, in parallel, or in series and parallel.

A first power voltage may be applied to the first power branch line ELVDDL, and a second power source voltage may be applied to the second power branch line ELVSSL. For example, during a period in which an image is displayed, the first power voltage may be greater than the second power source voltage.

When a scan signal having a turn-on level (here, a logic high level) is applied through the scan line SLi, the second transistor T2 may be turned on. In this case, a data voltage applied to the data line DLj may be stored in the first electrode of the storage capacitor Cst.

A positive driving current corresponding to a voltage difference between the first electrode and the second electrode of the storage capacitor Cst may flow between the first electrode and the second electrode of the first transistor T1. Accordingly, the light emitting diode LD may emit light with a luminance corresponding to the data voltage.

Next, when the scan signal having a turn-off level (here, a logic low level) is applied through the scan line SLi, the second transistor T2 may be turned off, and the data line DLj and the first electrode of the storage capacitor Cst may be electrically separated. Accordingly, even if the data voltage of the data line DLj is changed, the voltage stored in the first electrode of the storage capacitor Cst may not be changed.

The embodiments may be applied not only to the pixel PXij of FIG. 2, but also to pixels having other pixel circuits. For example, when the display device DD further includes the emission driver, the pixel PXij may further include a transistor connected to the emission line.

Figure 3:
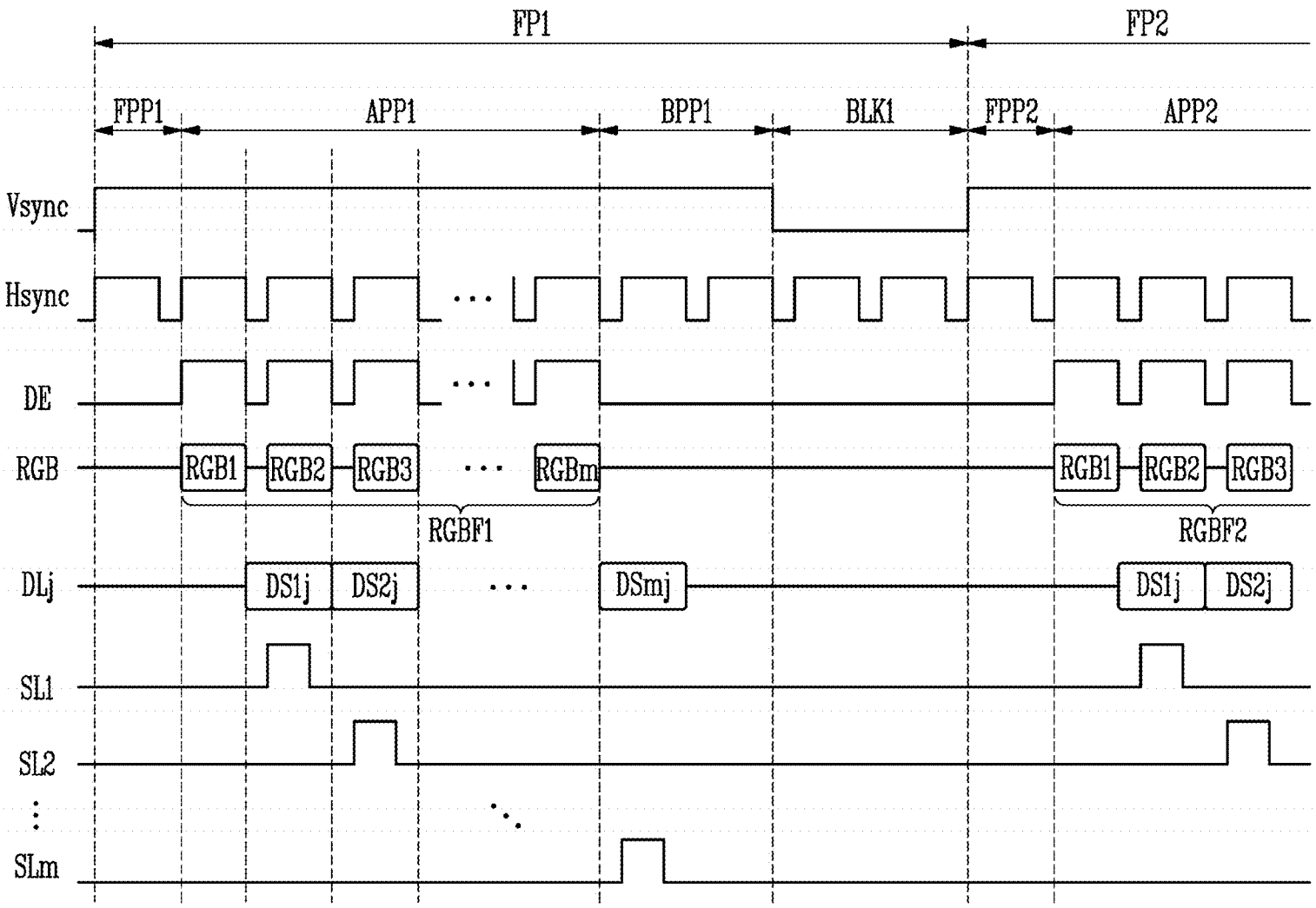
FIG. 3 is a diagram for explaining a driving method of a display device according to an embodiment of the present invention.

FIG. 3 is a diagram for explaining a driving method of a display device according to an embodiment of the present invention.

Referring to FIG. 3, consecutive first and second frame periods FP1 and FP2 are shown as an example. The first frame period FP1 may include a first front porch period FPP1, a first active period APP1, a first back porch period BPP1, and a first blank period BLK1. For example, the second frame period FP2 may include a second front porch period FPP2, a second active period APP2, a second back porch period, and a second blank period.

In an embodiment, for example, the first front porch period FPP1 may be a period in which the vertical synchronization signal Vsync is at the logic high level and the data enable signal DE is at the logic low level and may be a period before the supply of input grayscales RGB1, RGB2, RGB3, and RGBm starts.

In an embodiment, for example, the first active period APP1 may be a period in which the vertical synchronization signal Vsync is at the logic high level and the data enable signal DE includes the pulses of the enable level and may be a period in which the input grayscales RGB1, RGB2, RGB3, and RGBm are supplied.

In an embodiment, for example, the first back porch period BPP1 may be a period in which the vertical synchronization signal Vsync is at the logic high level and the data enable signal DE is at the logic low level and may be a period after the supply of the input grayscales RGB1, RGB2, RGB3, and RGBm ends.

In an embodiment, for example, the first blank period BLK1 may be a period in which the vertical synchronization signal Vsync is at the logic low level and the data enable signal DE is at the logic low level.

Hereinafter, description will be made based on the first frame period FP1, but this description may be applied equally to other frame periods (for example, input grayscales RGBF2 of the second frame period FP2).

In the first active period APP1, the data enable signal DE having the enable level (for example, the logic high level) may be supplied in units of horizontal periods (i.e., period supplying input grayscales to pixels in the same row). In this case, the input grayscales RGB1, RGB2, RGB3, and RGBm in units of horizontal lines (pixel rows) may be supplied in synchronization with the data enable signal DE of the enable level.

The data driver 12 may receive from the timing controller 11 the output grayscales converted from the input grayscales RGB1, RGB2, RGB3, and RGBm. According to an embodiment, the data driver 12 may serially receive the output grayscales corresponding to the input grayscales RGB1 in units of horizontal lines, and when the reception is completed, the data driver 12 may generate the data voltages by latching the output grayscales in parallel. Among these data voltages, a j-th data voltage DS1*j* may be applied to the j-th data line DLj. Similarly, some of the output grayscales corresponding to input grayscales RGB2 may be output as a data voltage DS2*j* in the next horizontal period, and some of the output grayscales corresponding to input grayscales RGBm may be output as a data voltage DSmj in the next horizontal period.

As the scan signals having the turn-on level (for example, the logic high level) are sequentially applied to the scan lines SL1, SL2, and SLm, the data voltages applied to the data lines may be written to corresponding pixels. For example, when the scan signal having the turn-on level is applied to the scan line SL1, data voltages DS1*j*, . . . may be written to the pixels of a first horizontal line (or pixel row). Next, when the scan signals of the turn-on level are applied to the scan line SL2, data voltages DS2*j*, . . . may be written to the pixels of a second horizontal line. By repeating this, when the scan signals of the turn-on level are applied to the last scan line SLm, data voltages DSmj, . . . may be written to the pixels of the last horizontal line.

In the first blank period BLK1, the data enable signal DE of the disable level (for example, the logic low level) may be supplied. In this case, the supply of the input grayscales RGB1 to RGBm may be stopped.

Figure 4:
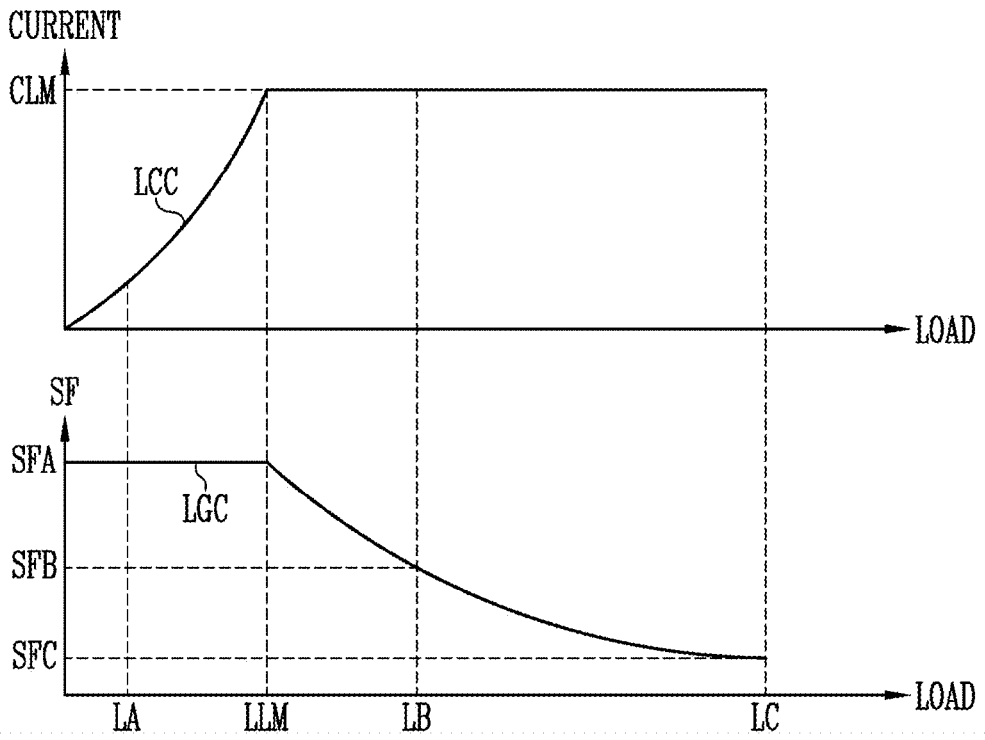
FIGS. 4 to 6 are diagrams for explaining a scale factor providing unit according to an embodiment of the present invention.
Figure 5:
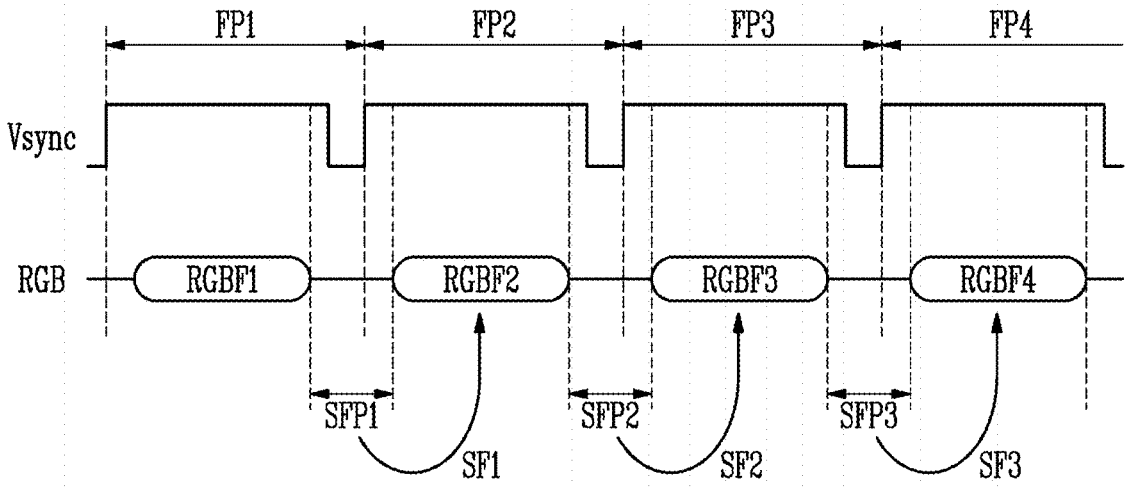
Figure 6:
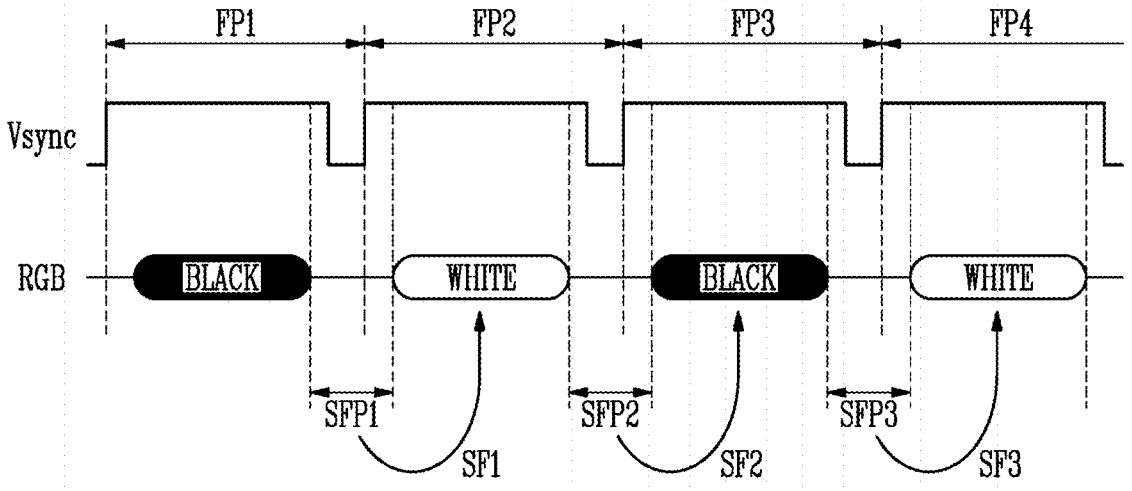

FIGS. 4 to 6 are diagrams for explaining a scale factor providing unit according to an embodiment of the present invention.

The graph LCC at the top of FIG. 4 shows a target global current that should flow to the display device DD in response to each load value LOAD. The graph LGC at the bottom of FIG. 4 shows the scale factor SF generated by the scale factor providing unit 15 in response to each load value LOAD.

In the graphs LCC and LGC, the load value LOAD at one time point may correspond to the input grayscales of one image frame. For example, the load value LOAD at one time point may be a value obtained by summing gamma conversion values of the input grayscales of one image frame. For example, the load value LOAD of the first frame period FP1 may be a value obtained by summing gamma conversion values of input grayscales RGBF1. The load value LOAD of the second frame period FP2 may be a value obtained by summing gamma conversion values of the input grayscales RGBF2. The gamma conversion values may refer to values obtained by converting the input grayscales into a luminance domain according to a selected gamma value. For example, the gamma value may be 2.0, 2.2, 2.4, or the like, and may be selected by a user or an algorithm. In another embodiment, the load value LOAD at one time point may be a value obtained by summing the input grayscales of one image frame.

When the load value LOAD increases according to an image pattern (for example, when an image gradually becomes brighter), the branch current required by the pixels increases, so that the global current flowing through the first power base line ELVDDLb may also increases.

The scale factor providing unit 15 may provide the scale factor SF so that the global current is smaller than a current limit value CLM. For example, the scale factor providing unit 15 may maintain the scale factor SF to the maximum when the global current is less than the current limit value CLM. In this case, the scale factor SF may be 1 (or 100%). The scale factor providing unit 15 may prevent an increase in current flowing through the first power base line ELVDDLb by reducing the scale factor SF when the global current exceeds the current limit value CLM. In this case, the scale factor SF may be less than 1 (or 100%). That is, in the image frame having the load value greater than a load value LLM corresponding to the current limit value CLM, the luminance corresponding to each grayscale may be decreased as the load value increases.

In an embodiment, for example, in a case of the pattern "A" where the load value is LA in FIG. 4, since the current flowing in response to the load value LA is smaller than the current limit value CLM, the scale factor providing unit 15 may provide the scale factor SFA of 1. Accordingly, the pixels corresponding to a white grayscale in the pattern "A" may emit light with a maximum luminance (for example, 1000 nits).

However, in a case of the pattern "B" where the load value is LB in FIG. 4, since the current flowing in response to the load value LB needs to be limited to be smaller than the current limit value CLM, the scale factor providing unit 15 may provide the scale factor SFB less than 1. Accordingly, the pixels corresponding to the white grayscale in the pattern "B" may emit light with a luminance lower than the maximum luminance (for example, 500 nits).

In addition, in a case of the pattern "C" where the load value is LC in FIG. 4, since the current flowing in response to the load value LC needs to be limited to be smaller than the current limit value CLM, the scale factor providing unit 15 may provide the scale factor SFC less than 1 and also less than the scale factor SFB. That is, the scale factor providing unit 15 may calculate the scale factor smaller as the load value of the input grayscales increases. For example, the scale factor providing unit 15 may calculate the first scale factor smaller as the load value of the input grayscales in the first frame period increases. Accordingly, the pixels corresponding to the white grayscale in the pattern "C" may emit light with a luminance lower than the maximum luminance (for example, 250 nits).

Referring to FIG. 5, frame periods FP1, FP2, FP3, and FP4 are shown as an example.

The scale factor providing unit 15 may calculate scale factors SF1, SF2, and SF3 in countable periods SFP1, SFP2, and SFP3, respectively. For example, a countable period may include a back porch period, a blank period, and a front porch period.

The scale factor providing unit 15 may calculate the scale factor SF of a current frame period after receiving all of the input grayscales RGB of the current frame period and before starting to receive the input grayscales RGB of the next frame period. For example, the scale factor providing unit 15 may calculate the first scale factor SF1 after receiving all of the input grayscales RGBF1 of the first frame period FP1 and before starting to receive the input grayscales RGBF2 of the next frame period FP2. Here, the frame period FP2 is a frame period immediately next to the first frame period FP1.

The grayscale converter 16 may calculate the output grayscales by applying the first scale factor SF1 to the input grayscales RGBF2 received during the second frame period FP2.

When the display device DD does not have the frame memory, the display device DD cannot display the image frame with a delay. Accordingly, the pixels may start to display the image based on the output grayscales converted from the input grayscales RGBF2 during the second frame period FP2. Also, the pixels may end displaying the image during a third frame period FP3 which is after the second frame period FP2. This is because new input grayscales RGBF3 are written to the pixels in the third frame period FP3.

Temporally adjacent image frames may include similar input grayscales. Therefore, even in the case that the scale factor SF1 of the first frame period FP1 instead of the scale factor SF2 of the second frame period FP2 is applied to the input grayscales RGBF2 of the second frame period FP2, limitation of the current of FIG. 4 may be appropriately applied to prevent the overcurrent.

According to the above-described embodiment, since the display device DD can prevent the overcurrent without having the frame memory, the cost of configuring the display device DD can be effectively reduced.

Referring to FIG. 6, a case in which input grayscales corresponding to a worst pattern are input during frame periods FP1, FP2, FP3, and FP4 is shown. In describing FIG. 6, it is assumed that the display device DD does not include the current limiting unit 18 of FIG. 1.

In the worst pattern, temporally adjacent image frames may include different input grayscales. For example, in odd-numbered frame periods FP1 and FP3, input grayscales BLACK corresponding to a full-black image may be input, and in even-numbered frame periods FP2 and FP4, input grayscales WHITE corresponding to a full-white image may be input.

In this case, the first scale factor SF1 set to the maximum based on the input grayscales BLACK of the first frame period FP1 may be applied to the input grayscales WHITE of the second frame period FP2. In this case, there is a problem in that an overcurrent occurs when an image based on the input grayscales WHITE of the second frame period FP2 is displayed.

Figure 7:
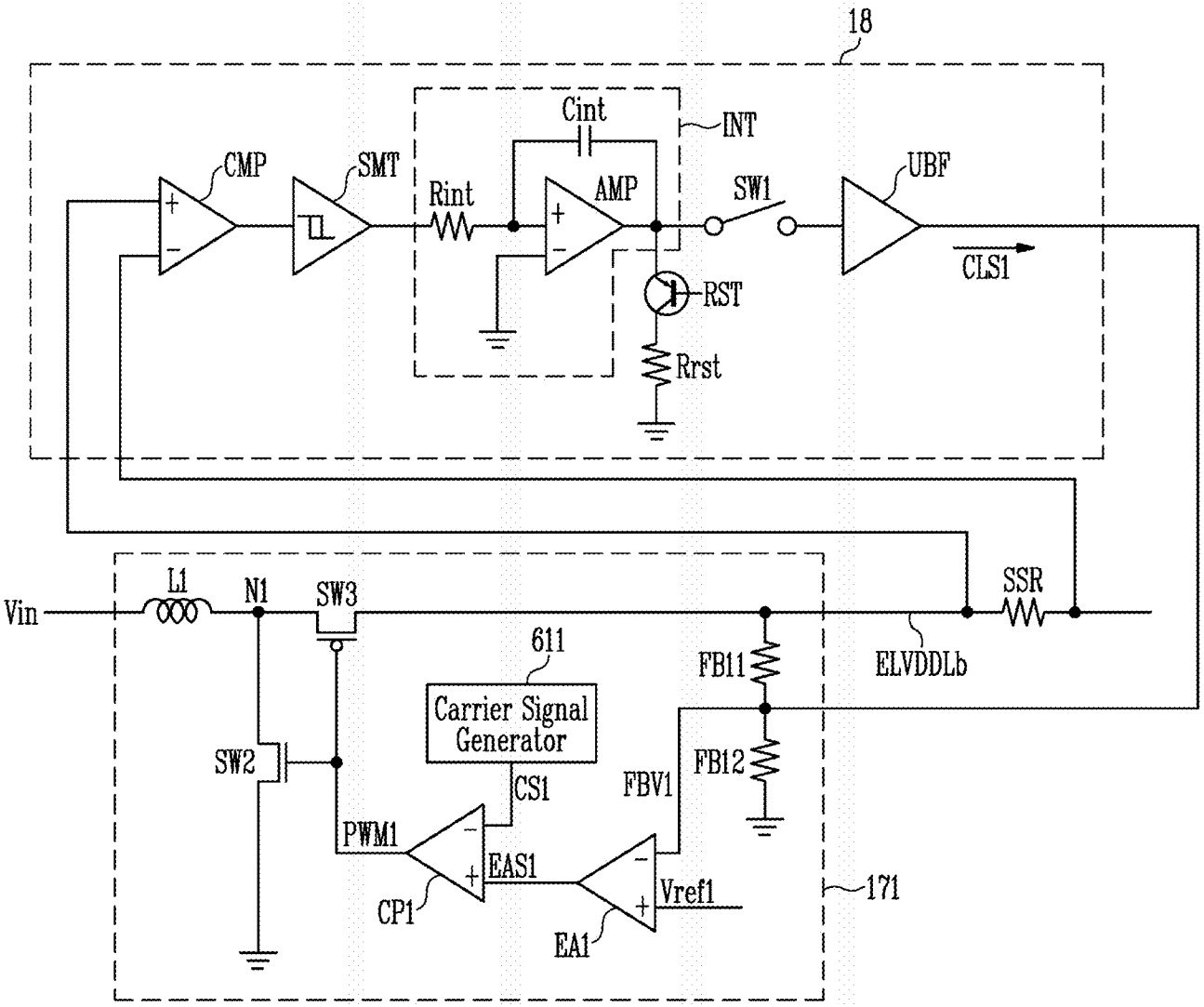
FIGS. 7 to 9 are diagrams for explaining a current limiting unit according to an embodiment of the present invention.
Figure 8:
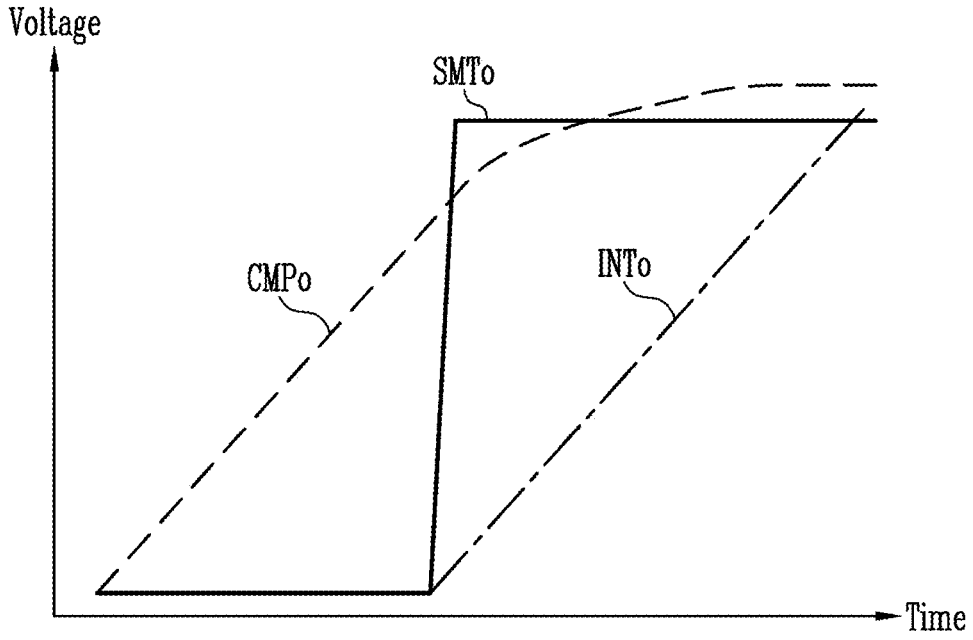
Figure 9:
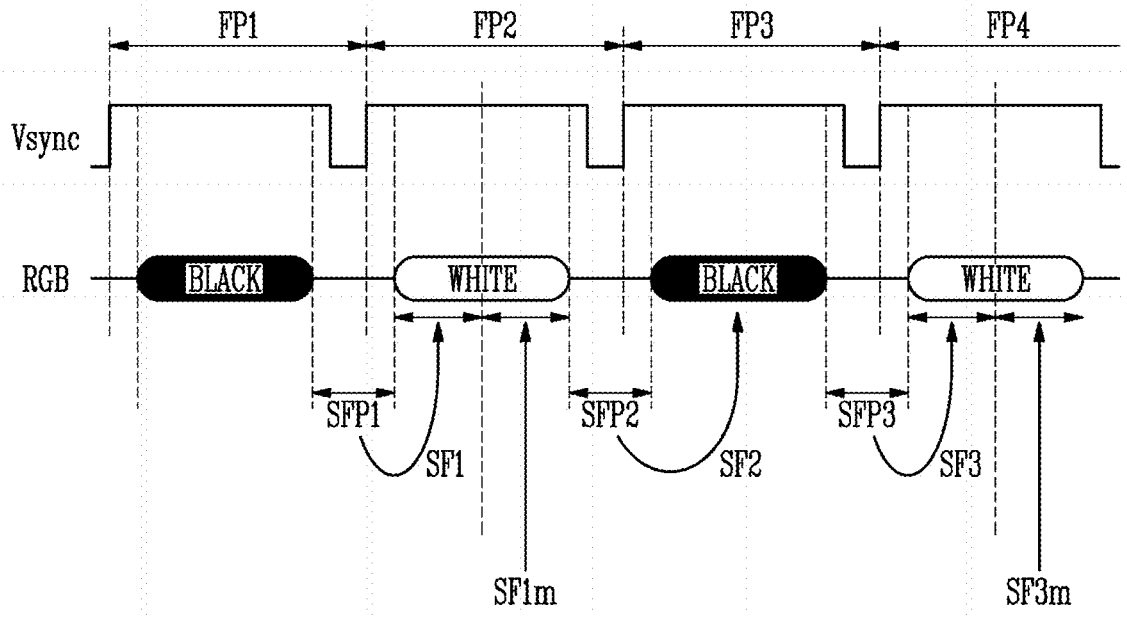

FIGS. 7 to 9 are diagrams for explaining a current limiting unit according to an embodiment of the present invention.

Referring to FIG. 7, configurations of a first power source 171 and the current limiting unit 18 are shown as an example.

The first power source 171 may convert an input voltage Vin received through an input terminal to supply the first power voltage to an output terminal. The output terminal may be connected to the first power base line ELVDDLb. For example, the first power source 171 may be a boost converter. The first power source 171 may be composed of other converters using conventional technology.

The first power source 171 may include an inductor L1, a switch SW2, and a switch SW3. In addition, the first power source 171 may include a carrier signal generator 611, a comparator CP1, an error amplifier EA1, and feedback resistors FB11 and FB12 for controlling the switch SW2 and the switch SW3.

The inductor L1 may have one end connected to the input terminal and the other end connected to a node N1. The switch SW2 may have a first electrode connected to the node N1 and a second electrode connected to a ground power source. The switch SW3 may have a first electrode connected to the node N1 and a second electrode connected to the output terminal. According to an embodiment, the switch SW3 may be replaced with a diode in which an anode is connected to the node N1 and a cathode is connected to the output terminal.

The feedback resistors FB11 and FB12 may be connected in series between the output terminal and the ground power source. An inverting terminal of the error amplifier EA1 may be connected to a node between the feedback resistors FB11 and FB12 to receive a feedback voltage FBV1. A non-inverting terminal of the error amplifier EA1 may receive a reference voltage Vref1.

The error amplifier EA1 may increase the magnitude of an error signal EAS1 in a positive direction as the reference voltage Vref1 is greater than the feedback voltage FBV1. The error amplifier EA1 may increase the magnitude of the error signal EAS1 in a negative direction as the reference voltage Vref1 is smaller than the feedback voltage FBV1. In another embodiment, the error amplifier EA1 may provide the error signal EAS1 having a minimum size when the reference voltage Vref1 is less than the feedback voltage FBV1.

The carrier signal generator 611 may provide a carrier signal CS1. The carrier signal CS1 may be a signal in which a triangular wave is periodically repeated. The carrier signal generator 611 may employ a conventional configuration for pulse width modulation ("PWM") driving.

An inverting terminal of the comparator CP1 may receive the carrier signal CS1, and a non-inverting terminal of the comparator CP1 may receive the error signal EAS1. The comparator CP1 may output a pulse when the error signal EAS1 is greater than the carrier signal CS1, and may not output the pulse when the error signal EAS1 is smaller than the carrier signal CS1. The output signal of such comparator CP1 may be referred to as a PWM signal PWM1, and a pulse width with respect to a cycle of the pulse may be referred to as a duty ratio. That is, as the pulse width increases, the duty ratio may increase.

In response to the pulse of the PWM signal PWM1, the switch SW2 may be turned on and the switch SW3 may be turned off. That is, the longer the pulse width (ON-duty period), the longer the period during which the switch SW2 is turned on. In this case, a current may flow from the input voltage Vin to the ground power source through the inductor L1, and energy may be stored in the inductor L1.

On the other hand, during an OFF-duty period in which no pulse is generated, the switch SW2 may be turned off and the switch SW3 may be turned on. In this case, as currents flowing from the input voltage Vin and the first inductor L1 are added, the first power voltage greater than the input voltage Vin may be applied to the output terminal, that is, the first power base line ELVDDLb. As the duty ratio increases, the first power voltage may be boosted to a greater degree.

The current limiting unit 18 may provide the first current limiting signal CLS1 to the first power source 171 when the current of the first power base line ELVDDLb exceeds the reference value. For example, the current limiting unit 18 may provide the first current limiting signal CLS1 to the node between the feedback resistors FB11 and FB12. In this case, the feedback voltage FBV1 of the first power source 171 may be set based on the first current limiting signal CLS1, and the primary current limiting using the first power source 171 may be performed. That is, the first power voltage applied to the first power base line ELVDDLb may decrease.

The current limiting unit 18 may include a comparator CMP, a trigger SMT, an integrator INT, a buffer UBF, a switch SW1, a reset switch RST, and a reset resistor Rrst.

Input terminals of the comparator CMP may be connected to the first power base line ELVDDLb. For example, the input terminals of the comparator CMP may be connected to both ends of a sensing resistor SSR of the first power base line ELVDDLb. In FIG. 7, the sensing resistor SSR is connected in series with the first power base line ELVDDLb, but according to an embodiment, the sensing resistor SSR may be connected in parallel with the first power base line ELVDDLb. Referring to FIG. 8, it is assumed that an output voltage CMPo of the comparator CMP increases as the global current increases.

An input terminal of the trigger SMT may be connected to an output terminal of the comparator CMP, and an output terminal of the trigger SMT may be connected to an input terminal of the integrator INT. For example, the trigger SMT may be a Schmitt trigger. In addition, the trigger SMT may employ other conventional circuits. Referring to FIG. 8, when the output voltage CMPo of the comparator CMP exceeds a threshold value, the trigger SMT may output an output voltage SMTo of a high logic level.

An input terminal of the integrator INT may be connected to the output terminal of the trigger SMT. The integrator INT may include an amplifier AMP, a resistor Rint, and a capacitor Cint. The resistor Rint may be connected between a first terminal (for example, a non-inverting terminal) of the amplifier AMP and the input terminal of the integrator INT. The capacitor Cint may be connected between the first terminal (for example, the non-inverting terminal) of the amplifier AMP and an output terminal of the integrator INT. A second terminal (for example, an inverting terminal) of the amplifier AMP may be connected to the ground power source or a reference power source. In addition, the integrator INT may employ other conventional circuits. Referring to FIG. 8, as the output voltage SMTo of the high logic level of the trigger SMT is continuously received, an output voltage INTo of the integrator INT may gradually increase.

The buffer UGF may have an input terminal connected to the output terminal of the integrator INT and an output terminal connected to the node between the feedback resistors FB11 and FB12. The buffer UGF may be a unit gain buffer. When viewed from the output terminal, the buffer UFF may have infinite resistance at the input terminal side. Accordingly, problems such as reverse current flow and the like can be effectively prevented.

The switch SW1 may be positioned between the output terminal of the integrator INT and the input terminal of the buffer UGF. The current limiting unit 18 may function when the switch SW1 is in a turned-on state, and the current limiting unit 18 may not function when the switch SW1 is in a turned-off state. The switch SW1 may be an optional component, and may be excluded from the configuration of the current limiting unit 18 according to embodiments.

The reset switch RST may have a first electrode connected to the output terminal of the integrator INT. The reset resistor Rrst may be connected between a second electrode of the reset switch RST and the ground power source. When the reset switch RST is turned on, a voltage of the output terminal of the integrator INT may be initialized. In an embodiment, a turn-on cycle of the reset switch RST may be set in a specific time unit. For example, the turn-on period of the reset switch RST may be one frame period.

When the worst pattern of FIG. 6 is input to the display device DD, an operation of the scale factor providing unit 15 will be described with reference to FIG. 9.

In an embodiment, for example, the scale factor providing unit 15 may calculate the first scale factor SF1 based on the input grayscales BLACK received during the first frame period FP1. The grayscale converter 16 may calculate the first output grayscales by applying the first scale factor SF1 to the first input grayscales (a part of the WHITE) received during the second frame period FP2 after the first frame period FP1. At least a part of the pixels (for example, the pixels connected to the n-th scan line from the first scan line SL1) may display the image based on the first output grayscales (see FIG. 1).

In this case, since the first scale factor SF1 is set to the maximum based on the input grayscales BLACK of the first frame period FP1, the overcurrent may occur in the first power base line ELVDDLb. The current limiting unit 18 may provide the second current limiting signal CLS2 to the scale factor providing unit 15 when the current of the first power base line ELVDDLb exceeds the reference value. For example, the second current limiting signal CLS2 may be the same analog signal as the first current limiting signal CLS1. In another embodiment, the second current limiting signal CLS2 may be a value obtained by digitally converting the first current limiting signal CLS1.

When receiving the second current limiting signal CLS2, the scale factor providing unit 15 may provide a second scale factor SF1*m* smaller than the first scale factor SF1. The grayscale converter 16 may calculate the second output grayscales by applying the second scale factor SF1*m* to the second input grayscales (the rest of the WHITE) received during the second frame period FP2. Another part of the pixels (for example, the pixels connected to the (n+1)th scan line to the m-th scan line SLm) may display the image based on the second output grayscales (see FIG. 1).

That is, during the second frame period FP2, a part of the pixels of the pixel unit 14 may display the image to which the first scale factor SF1 is applied, and another part of the pixels may display the image to which the second scale factor SF1*m* is applied. Accordingly, since the scale factor SF can be changed in real time even during the frame period, the occurrence of overcurrent in the worst pattern can be effectively prevented even when the display device DD does not have the frame memory.

Since the same description may be applied to scale factors SF3 and SF3*m* of the third frame period FP3 and a fourth frame period FP4, duplicate descriptions will be omitted.

Figure 10:
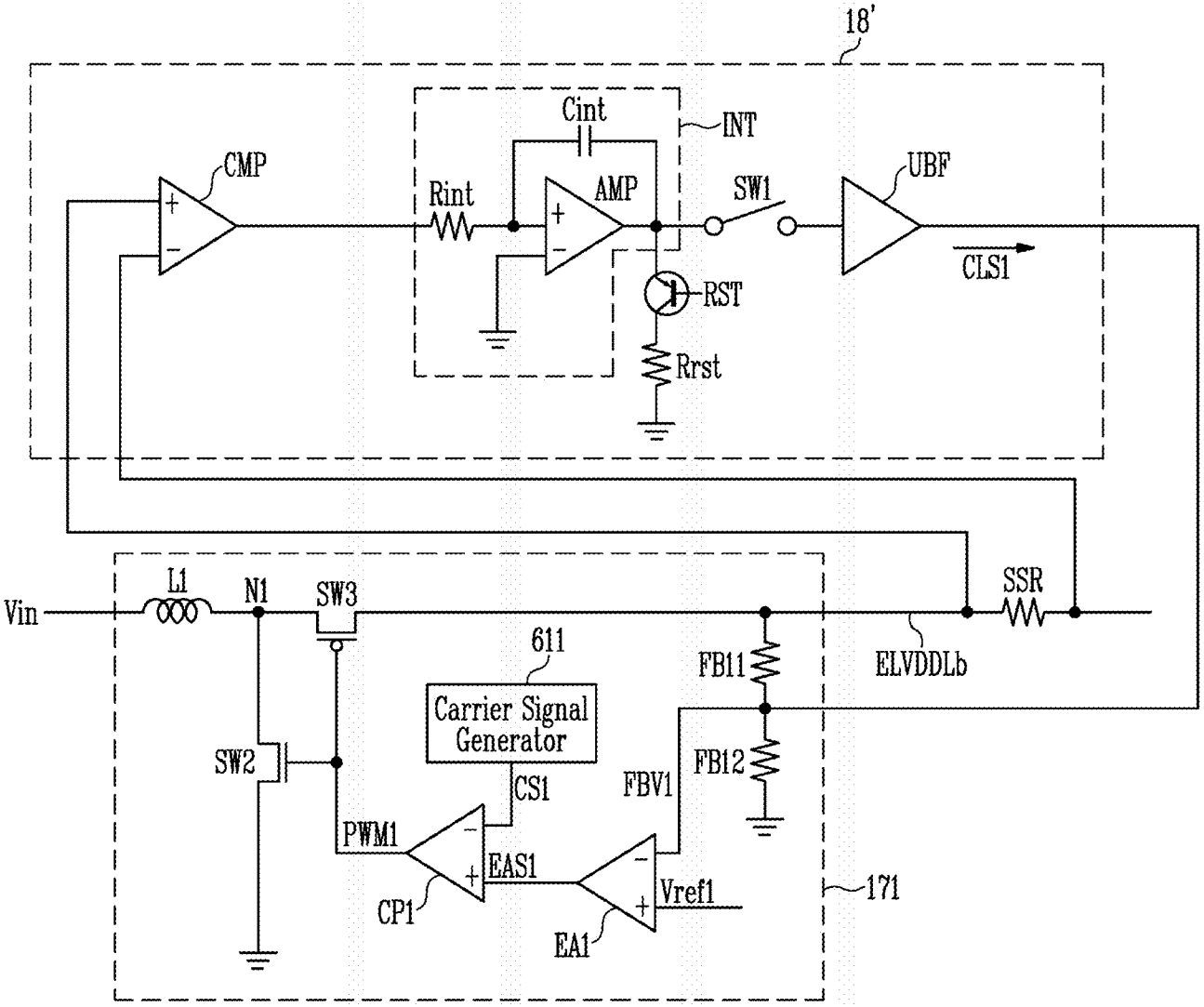
FIG. 10 is a diagram for explaining a current limiting unit according to another embodiment of the present invention.

FIG. 10 is a diagram for explaining a current limiting unit according to another embodiment of the present invention.

A current limiting unit 18' of FIG. 10 may not include the trigger SMT as compared to the current limiting unit 18 of FIG. 7. That is, the input terminal of the integrator INT may be directly connected to the output terminal of the comparator CMP. Except for a detailed setting value, since an operation of the current limiting unit 18' is substantially the same as that of the current limiting unit 18, duplicate descriptions will be omitted.

Figure 11:
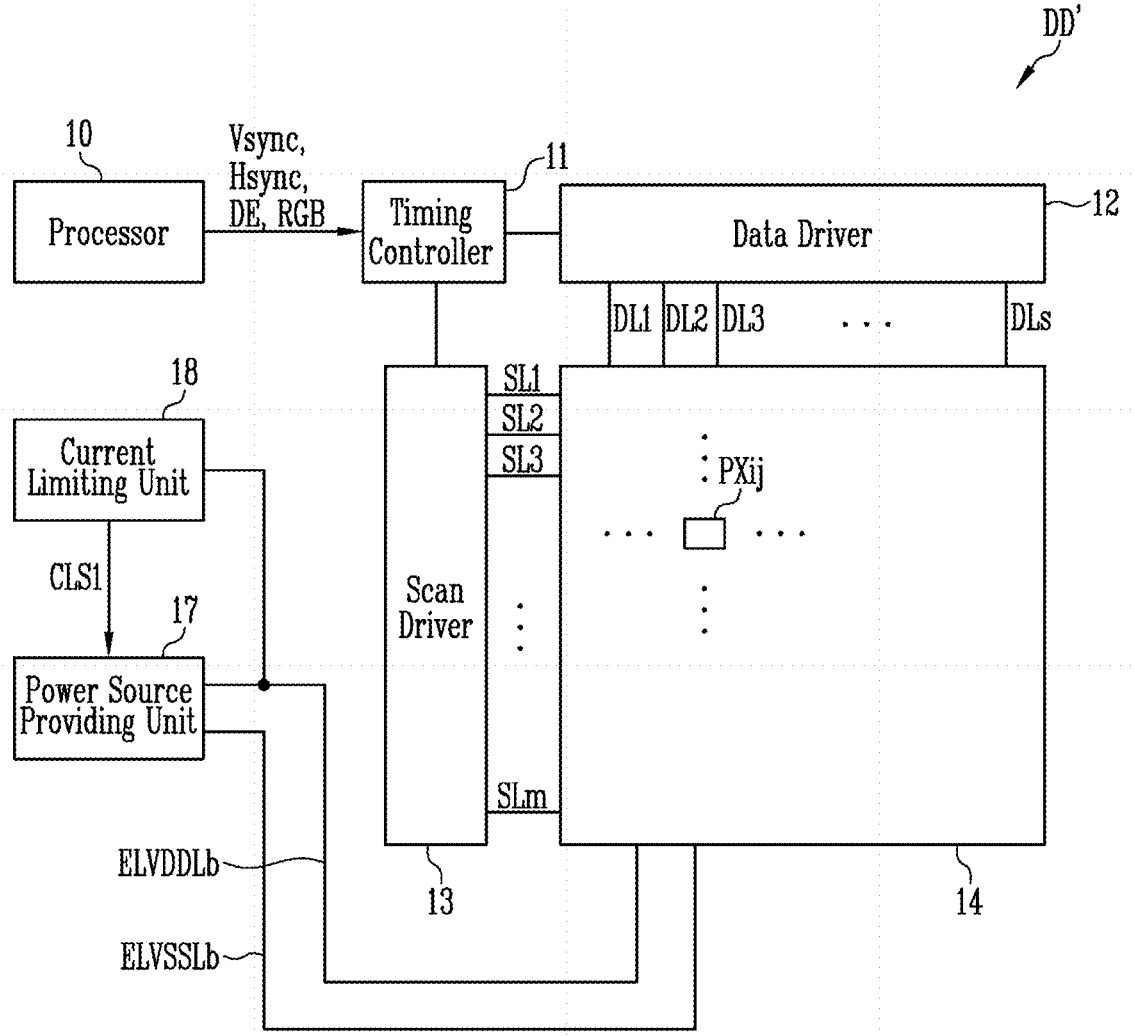
FIG. 11 is a diagram for explaining a display device according to another embodiment of the present invention.

FIG. 11 is a diagram for explaining a display device according to another embodiment of the present invention.

A display device DD' of FIG. 11 may not include the scale factor providing unit 15 and the grayscale converter 16 as compared to the display device DD of FIG. 1. In this case, the current limiting unit 18 may be configured to provide only the first current limiting signal CLS1 without providing the second current limiting signal CLS2.

The present embodiment differs from the display device DD of FIG. 1 in that the primary current limiting is performed by the first power source and the secondary current limiting is not performed.

The display device and the driving method thereof according to the present invention can prevent the occurrence of overcurrent in the worst pattern even when the frame memory is not provided.

The drawings referred to heretofore and the detailed description of the invention described above are merely illustrative of the invention. It is to be understood that the invention has been disclosed for illustrative purposes only and is not intended to limit the meaning or scope of the invention as set forth in the claims. Therefore, those skilled in the art will appreciate that various modifications and equivalent embodiments are possible without departing from the scope of the invention. Accordingly, the true technical protection scope of the invention should be determined by the technical idea of the appended claims.

What is claimed is:

1. A display device comprising:

a scale factor providing unit which calculates a first scale factor based on input grayscales received during a first frame period;

a grayscale converter which calculates first output grayscales by applying the first scale factor to first input grayscales received during a second frame period, wherein the second frame period is a frame period immediately next to the first frame period;

pixels connected to power branch lines commonly connected to a power base line, wherein at least a part of the pixels is configured to display an image based on the first output grayscales;

a power source which supplies a power voltage to the power base line; and a current limiting unit which provides a first current limiting signal to the power source and provides a second current limiting signal to the scale factor providing unit when a current of the power base line exceeds a reference value.

2. The display device of claim 1, wherein the power source reduces a magnitude of the power voltage when receiving the first current limiting signal.

3. The display device of claim 1, wherein the scale factor providing unit provides a second scale factor smaller than the first scale factor when receiving the second current limiting signal.

4. The display device of claim 3, wherein the grayscale converter calculates second output grayscales by applying the second scale factor to second input grayscales received during the second frame period, and wherein another part of the pixels is configured to display an image based on the second output grayscales.

5. The display device of claim 4, wherein the pixels start to display the image based on the first output grayscales and the second output grayscales during the second frame period and end displaying the image during a third frame period after the second frame period.

6. The display device of claim 1, wherein the scale factor providing unit calculates the first scale factor after receiving all of the input grayscales of the first frame period and before starting to receive the first input grayscales of the second frame period.

7. The display device of claim 6, wherein the scale factor providing unit calculates the first scale factor smaller, as a load value of the input grayscales of the first frame period increases.

8. The display device of claim 7, wherein the load value is a sum of gamma conversion values of the input grayscales.

9. The display device of claim 1, wherein the power source includes feedback resistors, and wherein the current limiting unit provides the first current limiting signal to a node between the feedback resistors.

10. The display device of claim 9, wherein the current limiting unit includes:

a comparator having input terminals connected to the power base line;

an integrator having an input terminal connected to an output terminal of the comparator; and a buffer having an input terminal connected to the integrator and an output terminal connected to the node between the feedback resistors.

11. The display device of claim 10, wherein the current limiting unit further includes a trigger connected between the output terminal of the comparator and the input terminal of the integrator.

12. The display device of claim 11, wherein the current limiting unit further includes:

a switch connected between an output terminal of the integrator and the input terminal of the buffer; and a reset switch having a first electrode connected to the output terminal of the integrator.

13. A driving method of a display device including a power source which supplies a power voltage to a power base line, and pixels connected to power branch lines commonly connected to the power base line, comprising:

calculating a first scale factor based on input grayscales received during a first frame period;

calculating first output grayscales by applying the first scale factor to first input grayscales received during a second frame period, wherein the second frame period is a frame period immediately next to the first frame period;

displaying an image by at least a part of the pixels based on the first output grayscales; and providing a first current limiting signal to the power source and calculating a second scale factor smaller than the first scale factor when a current of the power base line exceeds a reference value.

14. The driving method of claim 13, further comprising: reducing a magnitude of the power voltage by the power source when receiving the first current limiting signal.

15. The driving method of claim 13, further comprising: calculating second output grayscales by applying the second scale factor to second input grayscales received during the second frame period; and displaying an image by another part of the pixels based on the second output grayscales.

16. The driving method of claim 15, wherein the pixels start to display the image based on the first output grayscales and the second output grayscales during the second frame period and end displaying the image during a third frame period after the second frame period.

17. The driving method of claim 13, wherein in the calculating of the first scale factor, the first scale factor is calculated after receiving all of the input grayscales of the first frame period and before starting to receive the first input grayscales of the second frame period.

18. The driving method of claim 17, wherein in the calculating of the first scale factor, the first scale factor is calculated smaller, as a load value of the input grayscales in the first frame period increases.

19. The driving method of claim 18, wherein the load value is a sum of gamma conversion values of the input grayscales.

20. The driving method of claim 13, wherein the power source includes feedback resistors, and wherein the power source receives the first current limiting signal through a node between the feedback resistors.

* * * * *